United States Patent [19]

Meech et al.

[11] Patent Number: 4,465,510

[45] Date of Patent: Aug. 14, 1984

[54] AGGLOMERATION OF IRON ORES AND CONCENTRATES

[75] Inventors: John A. Meech; John G. Paterson, both of Kingston, Canada

[73] Assignee: Queen's University at Kingston, Kingston, Canada

[21] Appl. No.: 505,766

[22] Filed: Jun. 20, 1983

[51] Int. Cl.[3] ..... C22B 1/14

[52] U.S. Cl. ..... 75/3; 75/5; 427/217; 427/376.7

[58] Field of Search ..... 75/1 R, 3–5; 427/217, 376.7

[56] References Cited

U.S. PATENT DOCUMENTS

| | | | |
|---|---|---|---|
| 3,645,717 | 2/1972 | Meyer et al. | 75/5 |
| 3,765,869 | 10/1973 | Schierloh et al. | 75/3 |
| 4,257,881 | 3/1981 | Kindig et al. | 75/1 R |

OTHER PUBLICATIONS

Merriman, A. D., *A Dictionary of Metallurgy,* McDonald & Evans, Ltd., London, p. 137, (1958).

*Chemical Abstracts,* vol. 43, p. 2876, No. 7892f, Oct. 25, 1949.

*Primary Examiner*—Michael L. Lewis

*Attorney, Agent, or Firm*—Richard J. Hicks; Stanley E. Johnson

[57] ABSTRACT

A process for improving the compressive strength of iron ore agglomerates, such as pellets or briquettes, used as a feed to an iron blast furnace, in which the particulate iron ore is treated, either before or after agglomeration with sufficient liquid or gaseous iron pentacarbonyl to provide about 2–5% carbonyl iron on the surfaces of the iron ore particles, following decomposition of the iron pentacarbonyl by heating, and induration of the pellets or briquettes.

1 Claim, 2 Drawing Figures

AGGLOMERATION OF IRON ORES AND CONCENTRATES

This invention relates to the agglomeration of iron ores and concentrates, and more particularly to the production of hard pellets or briquettes of iron ore suitable for use in a blast furnace.

It is, of course, known to agglomerate the fine mineral particles produced during beneficiation of iron ores by (a) sintering, (b) pelletizing, or (c) briquetting, so as to produce a product which is of sufficient size and hardness to be suitable as a charge material to an iron blast furnace. Sintering comprises heating a mass of concentrate particles and a carbonaceous fuel on a moving grate until incipient melting occurs and the particles become stuck to each other to form a large mass which can be broken up to form large chunks or lumps. Pelletizing comprises feeding concentrate particles, water and, usually, a bentonite binder to a rotating drum so as to produce a mass of green balls or pellets which are then hardened by heating to a temperature at which incipient melting at the contact points and recrystallization between adjacent particles occurs. Briquetting comprises pressing a mass of mineral concentrate particles in a mold and heating, either during or after pressing, to cause incipient melting at the contact points between the particles. The heating and hardening process, known as induration, is generally carried out at a temperature of about 1250° C.; the heat input being provided by burning fuel oil or natural gas and also from the exothermic oxidation of the lower order oxide minerals in the concentrate. Typically about 1 to 1.5 million BTU's per ton of pellets produced are required, however when magnetite is present in the concentrate at levels between 25 and 40 percent, the heat input is reduced to 0.75 to 1 million BTU's per ton.

It has long been known that the presence of metallic iron in the concentrate can substantially reduce the heat input required for induration of the pellets. It is known, therefore, to add iron powders, such as filings, scrap metal or in electrolytic form, to pellets so as to reduce the temperature required to make a hard pellet. It is also known that part of the iron ore may be pre-reduced in order to provide some elemental iron into the pellet for the same purpose.

I have now found that the form in which the iron is introduced into the pellet has a marked effect upon the induration temperature and that if the iron can be introduced in a size range of the order of 5 microns, the induration temperature can be reduced to as low as about 500° C., with the consequent saving of a considerable amount of fuel energy.

Thus, it is an object of the present invention to provide an improved process for indurating agglomerated iron ore.

Thus, by one aspect of this invention there is provided in a process for producing indurated agglomerates from particulate iron ore the improvement comprising mixing said particulate iron ore with at least 2% powdered iron derived from the decomposition of iron pentacarbonyl.

By another aspect of this invention there is provided a process for producing hard iron ore agglomerates comprising (a) treating particulate iron ore with iron pentacarbonyl at a temperature in the range 103°–300° C. so as to deposit thereon at least 2% carbonyl iron;

(b) agglomerating said treated particulate iron ore; and (c) indurating said agglomerates at a temperature in the range 500°–800° C. for a sufficient time so as to produce said hard agglomerates.

By yet another aspect there is provided a process for producing hard iron ore agglomerates comprising:

(a) agglomerating particulate said iron ore;

(b) treating said agglomerated iron ore with liquid or gaseous iron pentacarbonyl at a temperature in the range 103°–300° C. so as to deposit at least 2% carbonyl iron thereon; and (c) indurating said treated agglomerates at a temperature in the range 500°–800° C. for a sufficient time so as to produce said hard agglomerates.

The invention will be described in more detail hereinafter with reference to the drawings in which:

Figure 1:
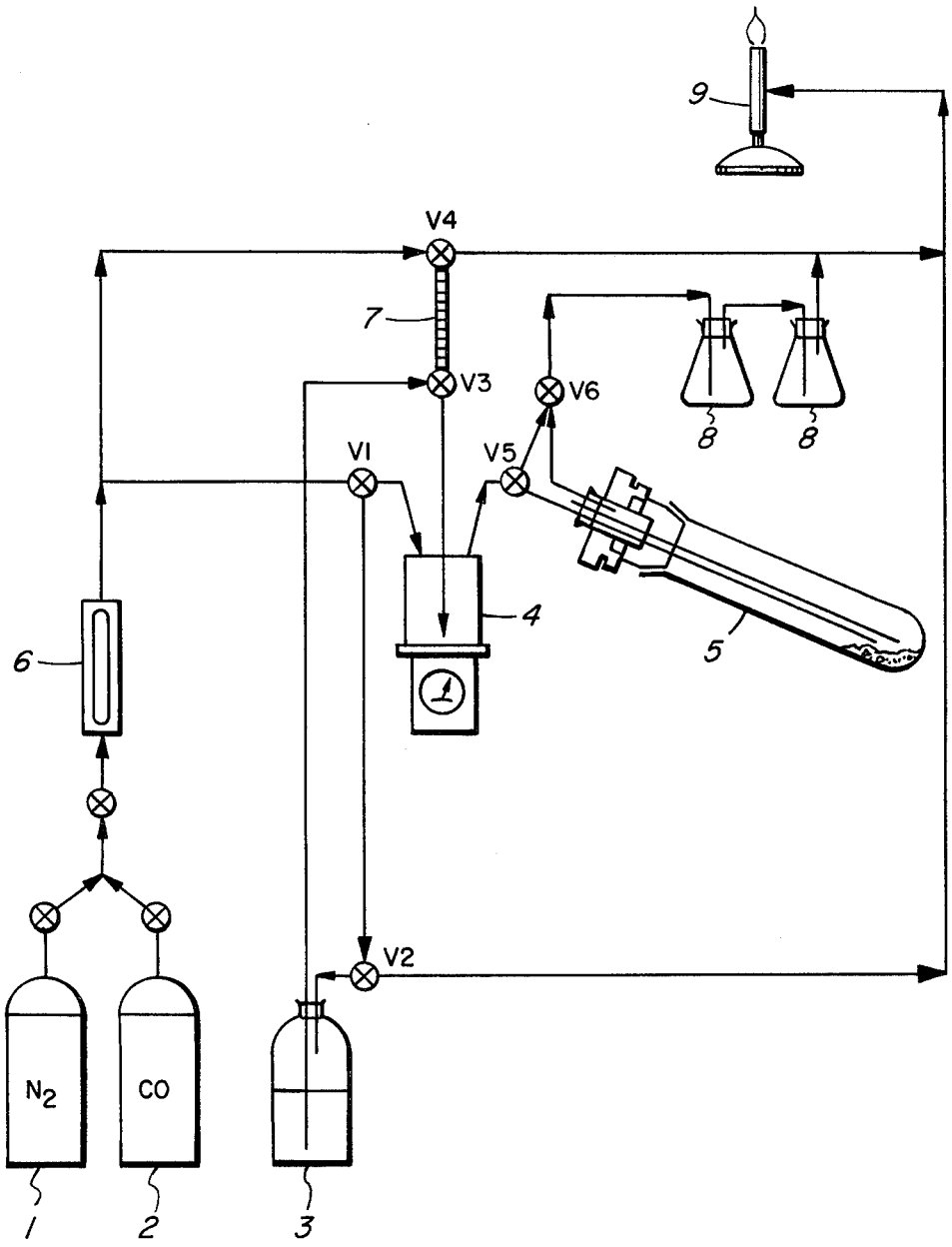
FIG. 1 is a schematic diagram of one form of apparatus used to carry out the process of the present invention.

Iron pentacarbonyl is a known, low boiling temperature (103° C.) compound which is liquid at room temperature, formed by the reaction of carbon monoxide and sponge iron at high pressure. Upon heating to a temperature in the range 103° C.–300° C., decomposition of the compound can be controlled in a manner so as to deposit a metallic iron coating onto the surfaces of particles exposed to the vapors.

$$Fe(CO)_5(g) \rightarrow Fe(s) = 5\ CO(g)$$

The process has been used, heretofore to produce iron powders having unique properties of high reactivity, perfect sphercial shape and closely controlled particle size. It has also been employed to selectively deposit a surface coating on certain minerals in a mixture to provide a means for selective magnetic separation, in such processes as the beneficiation of coal, sulphide and oxide copper ores and bauxite ores. It has not, however, been suggested heretofore that gaseous phase iron pentacarbonyl is a possible source of metallic iron in the production of indurated iron ore agglomerates such as briquettes or pellets.

The iron addition from iron pentacarbonyl may be made in any one of four different ways:

(a) Prior decomposition to powdered iron which is then blended with the ore forming the agglomerate charge;

(b) direct decomposition of iron pentacarbonyl onto iron mineral particles prior to agglomeration;

(c) direct decomposition of iron pentacarbonyl within an already formed agglomerate:

(i) from liquid iron pentacarbonyl added prior to agglomeration; or (ii) from gaseous iron pentacarbonyl added after agglomeration.

It has been found that addition of about 4–5 percent powdered carbonyl iron (about 2–8 micron in diameter and preferably 2–5 microns) to the agglomerate mixture (Method (a)) is sufficient to reduce the required induration temperature to produce a satisfactory pellet from about 1250° C. to about 500° C. Direct decomposition of the iron carbonyl onto the surfaces of the iron ore particles (Method (b)) reduces the iron required to achieve the same result to about 2 percent, although in this instance the carbon monoxide carrier gas is believed to contribute some partial reduction of the iron ore. Direct decomposition within an already formed agglomerate (Method (c)) is the preferred process as by forming an iron coating on the surface of contacting particles within a pellet, the particles are effectively welded together during heating through oxidation of the iron and tbhe diffusion of iron from the coating into the mineral particles. By ensuring that the iron addition is distributed at the critical points of contact within the agglomerate, the effect of oxidation and interparticulate bonding is maximized. This is a substantially different and distinct concept to that which pertains in the case of a partically pre-reduced pellet which has an oxygen deficiency distributed throughout the particles as opposed to the concentration of the deficiency at the particle surfaces in the case of an iron coating.

EXAMPLE 1

"C" grade carbonyl iron powder, 6–8 micron size from GAF was mixed with iron ore concentrate and the blend was then agglomerated by briquietting at 51,000 psi into briquettes 12.5 mm×12.5 mm diameter. The briquettes were indurated by heating from room temperature to 600° C. in 25 minutes, held by 600° C. for 20 minutes and then air quenched to room temperature. The compressive strength of the briquettes was then determined. Table I below sets forth the results obtained with different levels of iron carbonyl added, with three different types of iron ore concentrates.

TABLE I

| % Fe | % Voids | Crushing Strength Kg/pellet | Crushing Strength S.D. (Standard Deviation) |
|---|---|---|---|
| SAMPLE: Concentrate 'A' - Specularite mineralization 27.5% - 45 micron | | | |
| 0.0 | 20 | 27 | 2 |
| 2.5 | 21 | 241 | 18 |
| 5.0 | 22 | 501 | 47 |
| 10.0 | 24 | 681 | 49 |
| 15.0 | 24 | 904 | 95 |
| SAMPLE: Concentrate 'B' - Specularite mineralization 51.3% - 45 micron | | | |
| 0.0 | 22 | 38 | 5 |
| 2.5 | 23 | 205 | 12 |
| 5.0 | 24 | 502 | 28 |
| 10.0 | 25 | 794 | 33 |
| 15.0 | 25 | 897 | 58 |
| SAMPLE: Concentrate 'C' - Specularite mineralization 71.3% - 45 micron | | | |
| 0.0 | 23 | 97 | 3 |
| 2.5 | 24 | 192 | 12 |
| 5.0 | 26 | 506 | 30 |
| 10.0 | 27 | 728 | 38 |
| 15.0 | 27 | 765 | 54 |

SAMPLE: Concentrate 'D' - Mixed Hematite, Magnetite Hydrated Iron Oxides and Carbonates 68% - 45 micron indurated by firing at 800° C. for 1 hour and air quenching to room temperature

| % Fe | % Voids | Crushing Strength Kg/pellet | Crushing Strength S.D. | Crushing Strength No. Tests |
|---|---|---|---|---|
| 0.0 | 28 | 85 | 24 | 10 |
| 1.0 | 29 | 132 | 16 | 12 |
| 2.5 | 29 | 224 | 18 | 11 |
| 5.0 | 30 | 353 | 24 | 9 |
| 10.0 | 27 | 594 | 48 | 10 |
| 15.0 | 30 | 701 | 76 | 6 |

EXAMPLE 2

The procedure of Example 1 was repeated using iron powders of different sources in a mixture with an iron ore concentrate containing 27.5% specularite mineralization and 45 microns in size. The results are tabulated below in Table II.

TABLE II

SAMPLE: Concentrate 'A'

| Powder Type | % Fe | Crushing Strength Kg/pellet | Crushing Strength S.D. |
|---|---|---|---|
| Electrolytic Iron | 5 | 134 | 6 |
| (−150 micron size) | 10 | 296 | 41 |
| 'C' Carbonyl Iron | 5 | 501 | 47 |
| (6–8 micron size) | 10 | 681 | 49 |
| 'SF' Carbonyl Iron (3–4 micron size) | 5 | 703 | 13 |

EXAMPLE 3

10% Fe as 'C' Grade (GAF) carbonyl iron powder was mixed with 68% minus 45 micron concentrate D (Example 1) comprising mixed hematite, magnetite, hydrated iron oxide and carbonates and the blend was agglomerated by briquetting at 51,000 psi to produce 12.5 mm×12.5 mm diameter briquettes. These briquettes were then fired at selected temperatures for 1 hour, as shown in Table III below.

TABLE III

SAMPLE: Concentrate 'D'

| Temperature (°C.) | % Voids | Crushing Strength Kg/pellet | Crushing Strength S.D. | Crushing Strength No. Tests |
|---|---|---|---|---|
| 300 | 27 | 179 | 12 | 5 |
| 400 | 27 | 421 | 49 | 5 |
| 500 | 26 | 653 | 64 | 10 |
| 600 | 27 | 678 | 54 | 9 |
| 700 | 27 | 653 | 52 | 9 |
| 800 | 27 | 594 | 48 | 10 |
| 900 | 26 | 740 | 59 | 8 |
| 1000 | 26 | 749 | 54 | 5 |

EXAMPLE 4

The procedure of Example 3 was repeated except that the briquettes were indurated at 500° C. for selected periods of time, as set forth in Table IV below.

TABLE IV

SAMPLE: Concentrate 'D'

| Firing Time (minutes) | % Voids | Crushing Strength Kg/pellet | Crushing Strength S.D. | Crushing Strength No. Tests |
|---|---|---|---|---|
| 5 | 27 | 145 | 18 | 5 |
| 10 | 26 | 354 | 31 | 5 |
| 20 | 26 | 481 | 29 | 5 |
| 30 | 26 | 540 | 43 | 5 |
| 60 | 26 | 653 | 64 | 10 |
| 120* | 28 | 686 | 45 | 3 |

*(600° C.)

EXAMPLE 5

An apparatus, illustrated schematically in FIG. 1, was arranged to study the direct decomposition of iron pentacarbonyl onto the surfaces of particles of iron ore or concentrate followed by agglomeration and induration. Carrier gases were selected from nitrogen 1 and carbon monoxide 2 and employed to transfer iron pentacarbonyl 3 to vaporizer 4 and thence to rotary kiln reactor 5. Appropriate flowmeters 6 and 7 are provided as are valves $V_1$–$V_6$. Following decompositon of the iron pentacarbonyl onto selected concentrates as described below, the coated particles were removed from the reactor 5 and agglomerated into briquettes at 51,000 psi (12.5 mm × 12.5 mm diameter) and indurated by heating from room temperature to 600° C. in 25 minutes, held at 600° C. for 20 minutes and air quenched to room temperature. Reaction gases and excess carrier gases were cooled in traps 8 and exhausted at burner 9. The compressive strength of the indurated briquettes was then determined and the results are tabulated in Table V below.

TABLE V

| % Fe Deposited | Carrier Gas | Deposition Temperature (°C.) | Crushing Strength Kg/pellet | S.D. |
|---|---|---|---|---|
| SAMPLE: Concentrate 'A' | | | | |
| 0.5 | $N_2$ | 210 | 97 | 5 |
| 1.4 | $N_2$ | 160 | 100 | 4 |
| 2.5 | CO | 210 | 432 | 13 |
| 5.6 | $N_2$ | 170 | 517 | 62 |
| SAMPLE: Concentrate 'E' - Magnetite mineralization (100% + 210 micron size) | | | | |
| 0 | — | — | 349 | 25 |
| 3.3 | CO | 170 | 654 | 29 |
| 3.3* | CO* | 170* | 147* | — |

*Indurated and cooled under a nitrogen atmosphere

It is to be noted that cooling under a nitrogen atmosphere prevents oxidation of the iron film and consequently the crushing strength of the briquette is lowered, thus confirming that oxidation of the deposited iron film is responsible for achieving pellet strength in the same manner that magnetite oxidation leads to increased strength.

Figure 2:
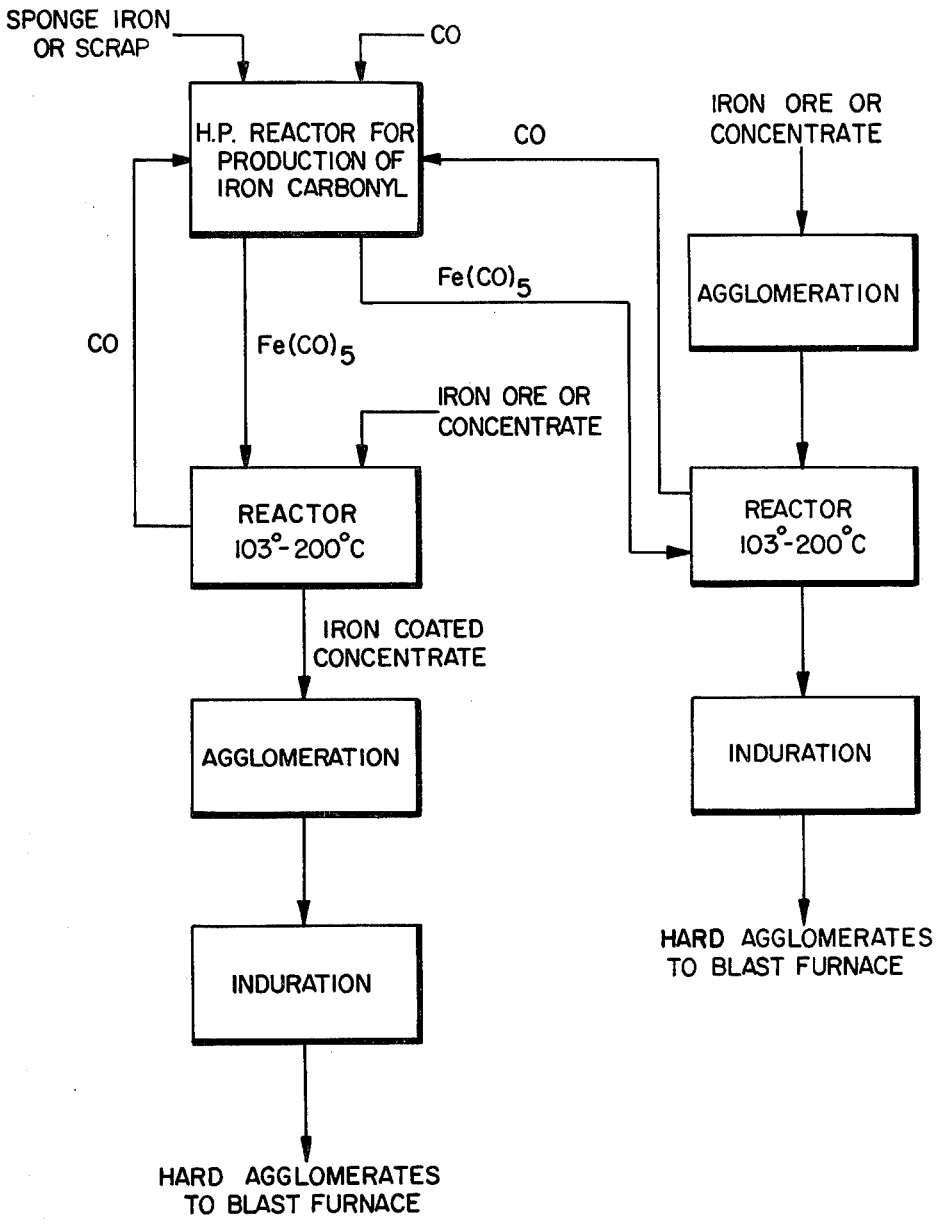
FIG. 2 is a schematic flow sheet showing two alternative processes according to the present invention.

FIG. 2 illustrates, in schematic form, two alternative flow diagrams for the operation of the present invention, showing agglomeration either before or after coating with carbonyl iron. It will, of course, be appreciated that the iron carbonyl fed to the reactor may be liquid or gaseous form as most appropriate for the particular feed system.

The use of iron carbonyl in the process of iron ore agglomeration offers several important advantages:

(1) the iron carbonyl is not a contaminant and indeed offers a simple method of further beneficiating the iron ore using relatively inexpensive scrap iron as th iron source;

(2) the reaction takes place at relatively low temperatures;

(3) significant reductions in the heating and fuel requirements; and (4) adaption of existing iron ore treatment plants to use this process are relatively straight forward and inexpensive.

I claim:

1. A process for producing hard iron ore agglomerates comprising:

(a) agglomerating particulate said iron ore;

(b) treating said agglomerated iron ore with gaseous iron pentacarbonyl at a temperature in the range 103°–300° C. so as to deposit at least 2% carbonyl iron thereon; and (c) indurating said treated agglomerates at a temperature in the range 500°–800° C. for a sufficient time so as to produce said hard agglomerates.

* * * * *